United States Patent [19]

Blendick

[11] Patent Number: 4,590,730

[45] Date of Patent: May 27, 1986

[54] PANEL AND GUTTER ASSEMBLY

[75] Inventor: Leonard E. Blendick, Toronto, Canada

[73] Assignee: Edward P. Minialoff, Schaumberg, Canada

[21] Appl. No.: 722,081

[22] Filed: Apr. 10, 1985

[30] Foreign Application Priority Data

May 8, 1984 [CA] Canada ..... 453855

[51] Int. Cl.[4] ..... E04C 1/34

[52] U.S. Cl. ..... 52/461; 52/466; 52/468

[58] Field of Search ..... 52/461, 463, 466, 468, 52/470, 459, 460, 469

[56] References Cited

U.S. PATENT DOCUMENTS

| | | | |
|---|---|---|---|
| 2,234,799 | 3/1941 | Eason | 52/466 X |
| 2,447,065 | 8/1948 | Goodwin | 52/461 |
| 2,725,832 | 12/1955 | Huntington | 52/461 X |
| 2,855,871 | 10/1958 | Huntington | 52/461 |
| 2,907,287 | 10/1959 | Trostle | 52/461 X |
| 3,327,443 | 6/1967 | Gay et al. | 52/463 X |
| 4,271,651 | 6/1981 | Sorrells, Jr. | 52/460 |
| 4,400924 | 8/1983 | Andrews | 52/466 |

*Primary Examiner*—Carl D. Friedman

*Attorney, Agent, or Firm*—Rogers, Bereskin & Parr

[57] ABSTRACT

A panel and gutter assembly includes a number of panels and gutters, each of which is located between two adjacent panels. Each gutter is generally U-shaped and is open along the top to collect water. Edge portions of the panels overlap the gutters, so that water overflowing from the panels will run into the gutters. A plurality of clips are provided for securing the gutters to the panels, and a batten member is provided covering a gutter.

18 Claims, 5 Drawing Figures

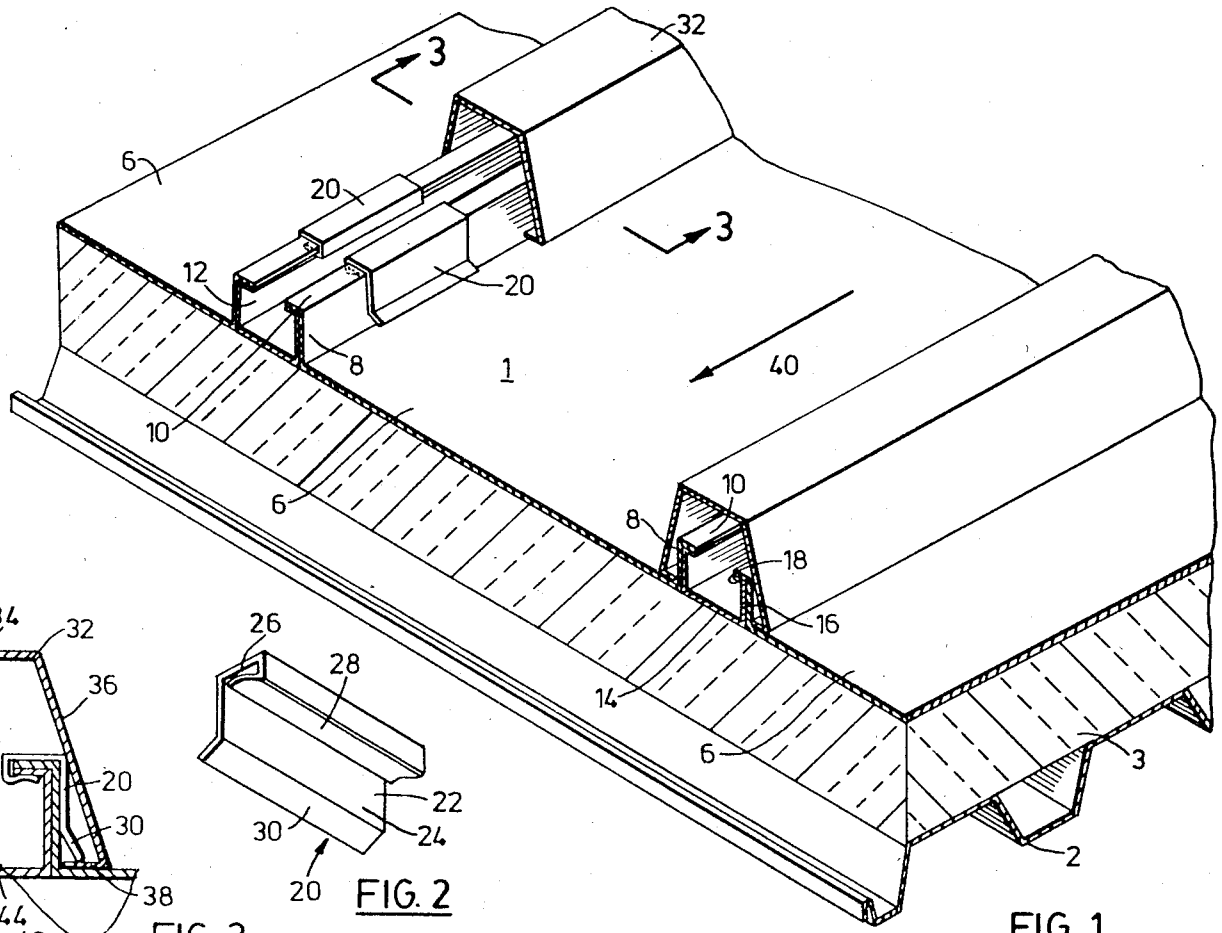
FIG. 1
FIG. 2
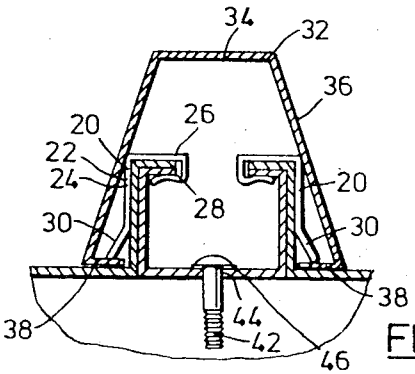
FIG. 3

PANEL AND GUTTER ASSEMBLY

This invention relates to a panel and gutter assembly and more particularly relates to a panel and gutter assembly for use as a roof of a structure.

Steel panels are well-known for roofing structures. When roofing a structure with steel panels, the actual panels themselves provide a simple continuous watertight surface, but difficulties can arise with the joints between adjacent panels.

Commonly, edge portions of the panels are upturned, and these upturned edges can be clipped together. A clip can be provided covering the joint, with the intention of preventing water finding its way between the panels.

It is also known to provide a channel or gutter between the edge portions of adjacent panels, with the intention that any water overflowing the edges of the panels will be conducted away down the gutters or channels. The following U.S. patents disclose this and other types of panel construction:

| | | | |
|---|---|---|---|
| 4,271,651 | Sorrells | 3,139,961 | Ferrell |
| 4,193,242 | Vallee | 3,055,147 | Goodwin |
| 3,975,880 | Fischer | 2,976,648 | Linck |
| 3,603,056 | Roth et al | 2,907,287 | Trostle |
| 3,402,521 | Tischuk | 2,784,814 | Bright |
| 3,376,680 | Gyekis | 2,447,065 | Goodwin |
| 3,335,537 | Mackey | 341298 | Swiss Patent |
| 3,327,443 | Gay et al | | |

These U.S. patents generally disclose relatively complex constructions, which use numerous different components. Some of the components are nailed to the roof structure, whilst some constructions provide various sorts of clips. Some of these constructions have a cover for the channel or gutter, which has to be bolted or screwed to a bracket in the channel or gutter, the bracket itself having a relatively complex mounting.

Such constructions are expensive and costly to manufacture and install. Further the use of numerous components only increases the possibility that some fault will occur, resulting in a leak in the roof. Also, the use of numerous components, frequently means that relatively tight tolerances have to be maintained, if the roof is to be assembled properly and is to be reliable. In practice, on a construction site, it is frequently difficult to ensure that such complex assemblies are constructed properly.

According to the present invention, there is provided a roofing assembly comprising:

a plurality of panels, edge regions of which each comprise an upstanding portion and an edge portion extending from an upper end of the respective upstanding portion towards an adjacent panel;

a plurality of gutters, each of which has a bottom and sides defining generally a U-shaped cross-section and is open along the top thereof to collect water, and each of which is located between two panels, with upstanding portions of those two panels adjacent sides of the gutter and the two respective edge portions located on top of the gutter extending towards one another;

a plurality of clips for securing the gutters to the panels, each of the clips including a first clip portion securing a gutter and a respective edge portion together, and second clip portion, the clips being arranged in pairs on either side of the gutter, with the second clip portion of each pair of clips extending out from the corresponding upstanding portion;

and a batten member having two limbs and a top section defining a generally inverted U-shape cross-section, the limbs being engaged by the second clip portions to retain the batten member in position.

In contrast to previous constructions, the roofing assembly of the present invention utilizes a relatively small number of parts. The components are conveniently formed from sheet steel. There is no need to provide numerous special clips, washers, sealing members and fastening elements. To assemble the roofing assembly, the gutters and panels are first located in position on the underlying support structure. They can be assembled together in a variety of ways. However, for each strip of the roof, preferably a panel is laid at one end of the strip. Then, a gutter can be positioned against the inner edge of that panel, with the gutter located under the edge portion of the panel. The next panel can then be located on the support structure, with its edge portion positioned on top of the gutter, like the other edge portion. Appropriate clips can then be snapped into position, securing the edge portions to the gutter. Finally, the batten member can be set down into position onto the clips. This procedure can be repeated for the next gutter and panel, which will be located against the opposite edge of the second panel laid. The procedure can then be repeated across the full width of the roof. In known manner, one will normally start with a bottom strip of the roof, and the next strip can be laid with the panels overlapping the panels in the first strip.

The clips used serve a dual function. The first clip portion of the clips serve to secure the roofing panels to the batten, whilst the second clip portions serve to secure the batten in position. This greatly simplifies the overall construction, and makes assembly simpler. The provision of separate elements for securing the panels in position and for securing the batten in position is eliminated.

The gutters themselves are secured in position by, for example, screws passing through the bottoms of the gutters into the underlying support structure. The screws are spaced as required along the length of the gutters. Known sealing arrangements, such as caulking compound or rubber washers, can be provided to seal the screws to the gutters, to prevent the penetration of moisture into the underlying support structure.

For a better understanding of the present invention, and to show more clearly how it may be carried into effect, reference will now be made, by way of example, to the accompanying drawings, which shows an embodiment of the present invention and in which:

FIG. 1 shows a perspective view of a roofing assembly according to the present invention, and an underlying support structure;

FIG. 2 shows a perspective view of a clip;

FIG. 3 shows a cross-section along the line 3—3 of FIG. 1.

Figure 4:
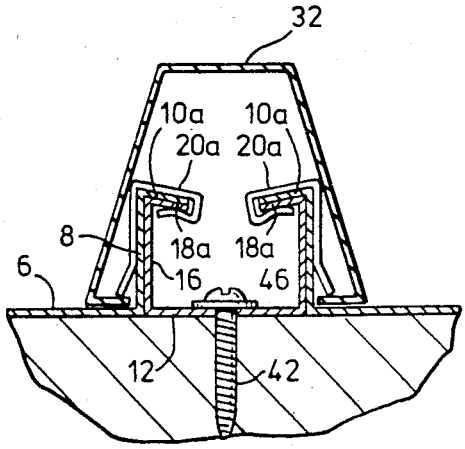
FIG. 4 shows a cross-section, similar to FIG. 3, of a variant of the roofing assembly.

Referring first to FIG. 1, there is shown a roofing assembly generally denoted by the reference 1. The roofing assembly is supported by an underlying support structure 2, and spaced from the support structure 2 by a layer of insulation 3. The support structure 2 and the insulation 3 can be formed in known manner, and do not form part of the present invention. For this reason, they will not be described in detail. In this described embodiment, the support structure is formed by corrugated steel sheets, having channels of trapezoidal cross-section, but it is to be appreciated that a wide variety of different support structures could be used. Similarly, the layer of insulation 3 could comprise any known insulation material.

The roofing assembly 1 comprises a plurality of panels 6. Here, a full section is shown for the central panel 6, but only the edges are shown of the left and right hand panels 6. The panels 6 are generally rectangular, and formed from sheet steel. As shown, two opposite edges of each panel 6 are bent to form coupling formations. Each of these edges includes an upstanding portion 8, which is generally vertical, and an edge portion 10, which extends generally parallel to the central portion of the sheet 6. The edge portions 10 extend outwards away from the center of the respective panel.

Between adjacent panels 6, as shown in the section of FIG. 1, gutters 12 are provided. Each gutter 12 has a bottom portion 14, and 2 generally vertical sides 16. Extending inwards towards one another from the upper edges of the vertical sides 16 are two lips 18, which are generally parallel with the bottom portion 14. The sides 16 and lips 18 are dimensioned to correspond to the upstanding portions 8 and edge portions 10 of the panels 6. Consequently, the upstanding portions 8 and edge portions 10 closely abut the sides 16 and lips 18, as shown most clearly in FIG. 3. If desired, a caulking or sealing compound can be provided between the facing surfaces of the gutters 8 and panel 6, to form a secure watertight seal, although this is not essential if no water can in any event penetrate between the gutter 12 and panels 6.

To secure the panels 6 to the gutters 12, clips 20 are provided. Each clip 20 comprises a central portion 22 of inverted L-shaped cross-section. The central portion 22 includes a side limb 24 and a top limb 26, which abut an upstanding portion 8 and an edge portion 10 respectively. The top limb 26 is continuous with a first clip portion 28. The first clip portion 28 includes a section generally parallel to the top limb 26 and extending back towards the side limb 24. Before assembly, the first clip portion 28 is close to the top limb 26. It includes, along its free edge, a downwardly curved lip, to enable it to be readily engaged with the edges of the edge portion 10 of a panel 6 and the lip 18 of a gutter 12. After engagement of the first clip portion 28 with these components 10, 18, the clip 20 is in the position shown in FIGS. 1 and 3. Here, the first clip portion 28 is displaced downwards, so that the corresponding edge portion 10 and inwardly extending lip 18 are securely clamped between the clip portion 28 and the top limb 26. The clip 20 also includes a second clip portion 30. As shown most clearly in FIG. 3, in the assembled condition, the second clip portion 30 extends outwards and downwards from the respective gutter 12.

As indicated in FIG. 1, the clips 20 are arranged in pairs on either sides of each gutter 12. The pairs of clips 20 are spaced along the length of each gutter 12, to form substantial spaces between the pairs of clip 20. To complete the joint between each pair of panels 6, a batten member 32, for each gutter 12 is provided. As shown, each batten member 32 has a generally trapezoidal cross-section. It has a flat top section 34, and two inclined side members 36. Extending inwards from the lower edges of the side member 36 are two lip portions 38. The width between the lip portions 38 is slightly greater than the overall width of two upstanding portions 8 located against a gutter 12. After assembly of two panels 6, a gutter 12 and associated clips 20, a respective batten member 32 can be located in position, by simply placing it on top of the clips 20, and then pressing it downwards. The second clip portions 30 are then pressed resiliently against the sides of the upstanding portions 8, to permit the lips 38 to pass over them. The batten member 32 can also be provided with a certain degree of resiliency, so that simultaneously the two lips 38 spring outwards, to permit them to pass over the clips 20. Once the batten member 32 is fully located in the position shown in FIG. 3, then the second portions 30, and where appropriate the lips 38, spring back into their original position. The lip portions 38 are then engaged under the ends of the second clip portions 30, to securely retain the batten member 32 in position. The sides 36 of the batten member then press against corners of the clip members 20. The various components are so dimenionsed that the lip portions 38 of the batten member 32 are slightly spaced from the main portions of the panels 6. Also, a slight gap is provided between the inner edges of the lip portions 38 and the upstanding portions 8. In the gaps or spaces between adjacent pairs of clip 20, water collecting on the panels 6 can then flow around the batten member 32 into the gap between the upstanding portions 8 and the batten member 32. When the water level becomes greater than the height of the upstanding portions 8, the water can then freely flow over the top of the upstanding and edge portions 8, 10, in the gaps between pairs of clips 20, into the gutter 12. The gutter 12 is arranged to conduct the water away in known manner. In this respect, it should be noted that the slope of the roof is in the direction indicated by arrow 40.

Whilst the drawings show an assembly of one row of panels extending transversely of the slope of the roof, in practice for roofs of any substantial area one will normally provide two or more rows of panels, with each row extending transversely with respect to the slope of the roof. In this case, the rows or panels are arranged with the lower edges of each row overlapping the corresponding upper edges of an adjacent row of panels. The gutters 12 can be provided in length corresponding to the length of the panels 6, and can be similarly arranged. This should ensure that, even if no sealing is provided between adjacent panels or it is defective, water should still be conducted away and should not be able to penetrate through the roof. To secure the roofing assembly to the support structure 2, screws or similar fastening elements 42 are provided passing through holes 44 in the gutter 12. Sealing elements 46, for example rubber washers or the like, are provided to ensure that no water can penetrate through these holes 44.

To construct the roofing assembly 1, the support structure 2 and insulation 3 are first assembled in known manner. Then, one panel 6 is positioned against an edge of the roof, with its two upstanding portions 8 extending in the direction of the slope 40 of the roof. A gutter 12 is positioned against the inner upstanding portion 8 of that panel 6, and located under the edge portion 10. The gutter 12 is then secured in position by means of screws or other fastening elements 42 passed through the holes 44 and through the insulation 3 into the support structure 2. Although the elements 42 are shown passing directly into the support structure 2, a connector, such as a circular cap or metal or metal channel can be imbedded in the insulation material. This may be necessary for steep slopes where the compressive strength of the insulation may not be adequate. As shown in FIG. 3, each screw 42 is provided with a sealing member 46, to maintain the integrity of the gutter 12.

Then, another panel 6 can be located with its upstanding portion 8 against the other side of the already laid gutter 12. Both these two panels 6 are secured to the gutter 12 by means of the clip members 20. Each clip member 20 is attached, by inserting the first coupling portion 28 into the gutter 12 and engaging the edges of the edge portion 10 and gutter lip 18 between the top limb 26 and the first clip portion 28. The clip member 20 is then pulled back and rotated, so as to fully engage the first clip portion 28 with the edge portion 10 and gutter lip 18, and so as to bring the second clip portion 30 adjacent the upstanding portion 8. The batten member 32 can then be engaged with the clip member 20. The next gutter 12 can then be positioned and secured like the first gutter 12 against the free upstanding portion 8 of the second panel 6, and this procedure can be repeated across the width of the roof. Preferably, the lower most row of panels 6 and other components are laid first. Then, when the next row is laid, its panels 6 will automatically overlap the upper edges of the previously laid row of panels 6.

The provisions of gutters 12, between adjacent panels 6, improves the drainage of a roof. Typically, a roof formed of this type of metal sheet panel, without any built in gutters, requires a slope giving a 4" drop for each foot in a horizontal direction.

A particular problem arises when there is a lot of snow accumulation or debris, such as leafs, accumulated on the roof. When the snow starts to melt, or if the debris is soaked, a water film can be present that can reach up several inches. Thus, although the rate at which water is running off the roof is quite low, the effective depth of water, due to the snow or debris, is quite large. In known roof constructions with standing seams, it is possible for such a water film to reach the top of the seam, and leakage can result. It is for this reason that known roof constructions require a steep slope, in order to ensure adequate drainage at all times.

In the present roof assembly, the gutters 12 provide considerably improved drainage. In use, if excess water starts to accumulate on the panels 6, then it can readily overflow into the gutters 12, and be carried away.

If there is snow or debris accumulation on the roof of the present invention, the gutters 12 will still be unobstructed. Thus, even if a film of moisture builds up giving an effective water depth greater than the depth of the batten member, the depth in the gutters 12 will still be quite low. Water can then freely run over into the gutters 12, and be drained away. There should thus never be a build up of water in the gutter sufficient to cause water to penetrate between the edge portions 10 of the panels and the lips 18 of the gutters 12. For this reason, it is expected that a slop giving a 1" fall for each foot in a horizontal direction should be sufficient. This should give considerable reduced building costs, since the requirements for a steep roof leaves substantial wedge shaped spaces under the roof which are difficult to use.

Figure 5:
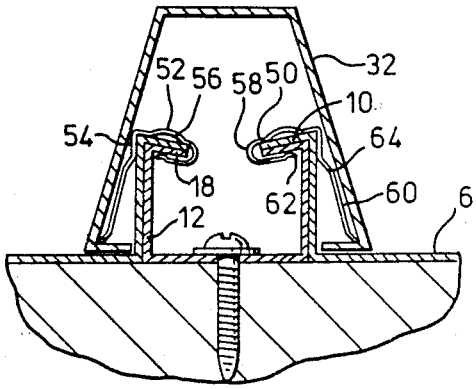
FIG. 5 shows a cross-section similar to FIG. 4, including an alternative clip.

Reference will now be made to FIGS. 4 and 5 which show variations of some of the elements of the previous Figures. Here, like parts are given the reference numerals used in FIGS. 1–3.

As previously mentioned, it may be necessary to provide a sealing compound between the gutter 12 and panels in the embodiment of FIGS. 1–3. FIG. 4 shows an embodiment having a different arrangement of the edge portions 10 of the panels 6 and the lips 18, in which a sealing compound should not be required. Here, edge portions **10*a* and lips 18*a* are still parallel to one another. They are now inclined downwards at an angle of 10° to the horizontal. Consequently any water that penetrates between a lip 18*a* and edge portion 10*a* will bend to flow down back into the gutter 12. The clips 20*a* are generally similar to the clips 20, but are shaped to correspond to the 10° slope provided for the lips 18*a* and edge portions 10*a***.

FIG. 5 shows a roofing assembly including the sloped edge portions **10*a* and lips 18*a* of FIG. 4. Here, clips 50 are provided. Each clip 50 includes a top limb 52 and a side limb 54. Extending from the top limb 52 is a first clip portion 58, and extending from the side limb 54 is a second clip portion 60. The top limb 52 includes an upwardly curved portion 56. The first clip portion 58 extends beneath the lip 18*a* and includes an upwardly curved portion 62, corresponding to the curved portion 56. The second clip portion 60 is inclined to the vertical and includes a connecting portion 64, which is more steeply inclined and which connects it to the side limb 54. A free edge region 66 of the second clip portion 60 is also steeply inclined and abuts the batten member 32. The clip 60 is fitted as described for the clip 20 above. Also, although the clip 60 is shown for the embodiment including the horizontal lips 18*a* and edge portions 10*a*, a corresponding version of the clip 60 can be incorporated in the embodiment of FIG. 4**.

A variety of materials and dimensions can be used for the various components, depending upon the particular conditions. For the gutters 12, steel, aluminum or copper could be used. The roof panels 6 can be also formed from any of these materials. Typically, the width of the panel 6 might be 12, 16, 18, 20 or 24", although other dimensions can be chosen. Although the panels are normally rectangular, trapezoidal panels could be used. Also, the height of the upstanding portions 8 and the width of the edge portions 10 can be chosen to suit a particular job.

The clips can either be manufactured from a spring steel or from the same material as other roof components. It is to be appreciated that the spring clips must retain the panels 6 against a variety of loads. The whole roofing assembly must be resistant to uplift due to wind suction. Such suction will tend to bend the panels 6 upwards in a convex manner. The effect of this will be to cause the clips to engage more tightly around the edge portion 10 of the panel 6 and the lip 8 of the gutter 12. Any wind load is thus transferred via the clips 20 to the gutter 12 and then via fastening elements 42 to the underlying support structure.

The roofing assembly 1 must also resist loads due to, for example, snow and ice which can impart a component of force parallel to the roofing assembly 1. This force has to be transferred through the spring clips 20, 60 for steep slopes a greater number of spring clips would be provided. Additionally for steep slopes the width of the panels can be reduced to effectively increase the density of spring clips. Alternatively, for a very steep slope, provision can be made for mechanical fastening of the clips 20,60. For example, screws can be provided passing through both the top limb 26 and first clip portion 28 of a clip 20 and through the edge portion 10 and gutter lip 18. Additionally, screws or the like can be provided to secure the batten member 32 to the clips 20. This will securely retain the batten member 32, even for very steep slopes.

With regard to the insulation, this typically has a low compressive stress, and this should be taken into account. Thus, the number of fastening elements or screws 42, hold down torque, and width of the gutters 12 should be chosen so as not to exceed the maximum allowable compressive stress for a particular insulation.

The roofing assembly of the present invention provides numerous advantages over other roofing systems. The spacing between batten centres can be readily varied, for different installations. The use of simple clips 20,60 in the embodiment shown automatically provides for thermal expansion and contraction; the battens 32 are free to move longitudinally with respect to other components. This should prevent excessive thermal stresses being built up. However, it should be noted that the roofing assembly 1 and support structure 2 will generally be subject to different amounts of thermal movement. If the panel/gutter assembly is free to move, it will suffer a change in length of 0.0756" in every 10' for steel and 0.156" in 10' for aluminum, for a 100° F. temperature difference. To prevent bending of panels, movement of fasteners in support, excessive stresses etc, the length of the panels should be limited to, say, 30' for steel and 15' for aluminum.

Additionally, the assembly 1 and insulation 3 will be subject to different amounts of thermal movement. The linear expansions of polystyrene and polyurethane are respectively 5.7 and 8.6 times the expansion of steel. This could result in excessive stresses being applied to the fasteners; particularly for large panels.

A black surface can attain a sol-air temperature of 180° F. or 100° F. above ambient, and because of this the colour of the roofing assembly should be chosen so that the insulation is not subjected to too high a temperature. For example, styrofoam has a maximum operating temperture of 165° F.

To ensure that the gutters 12 are securely positioned, the fastening elements or screws 42 can additionally be provided with a metal washer, to prevent the gutter 12 pulling off the elements 42. Also, to prevent depression of a gutter 12, due for example to snow load or a man's weight, screw threads can be provided on each screw 42 immediately below the gutter 12. The configuration of the assembly provides a clean simple appearance, as the batten members 32 completely conceal the gutters 12 and clips 20 securing them in position. Also, this arrangement should prevent the gutters 12 becoming clogged with leaves and other debris, thereby ensuring the gutters 12 are always available to conduct away excess water.

Although the roof assembly 1 is shown in the drawings installed on a steel support structure 2, it can be installed on any suitable support structure. Examples of other types of support structure are a concrete deck, solid wood or plywood deck, or precast or structural steel. The panels 6 can be provided in the form of completely insulated panels, or as a single skin decorative panel.

The gutters 12 are simply secured by means of screws or like fasteners, and this eliminates the need to provide Z-section or top hat section members between the roof assembly and the underlying support structure. The elimination of such members should reduce heat conduction between the inside and the outside of a building.

In known manner, the gutters 12 and the panels 6 can be arranged to conduct water into a hung or concealed main gutter system.

I claim:

1. A roofing assembly comprising:

a plurality of panels, edge regions of which each comprise an upstanding portion and an edge portion extending from an upper end of the respective upstanding portion towards an adjacent panel;

a plurality of gutters each of which has a bottom portion and sides defining a generally U-shaped cross-section and is open along a top thereof to collect water, and each of which is located between two panels with the upstanding portions of those two panels adjacent the sides of the gutter and with the two respective edge portions located on top of the gutter extending towards one another;

a plurality of clips for securing the gutters to the panels, each of the clips including a first clip portion holding a gutter and a respective edge portion together, and a second clip portion, the clips being arranged in pairs on either side of the gutter, with the second clip portions of each pair of clips extending out from the corresponding upstanding portions;

and a batten member having two limbs and a top section defining a generally inverted U-shape cross-section, the limbs being engaged by the second clip portions, to retain the batten member in position.

2. A roofing assembly as claimed in claim 1, wherein the upstanding portions of each panel are parallel and generally perpendicular to a central portion of the panel, and the sides of the gutter are parallel and perpendicular to the bottom of the gutter.

3. A roofing assembly as claimed in claim 2, wherein each gutter includes lip portions extending from upper edges of the sides of the gutter towards one another.

4. A roofing assembly as claimed in claim 3, wherein the edge portions of adjacent panels are flat and generally coplanar, and wherein the lip portions of each gutter are generally flat, coplanar and abut respective edge portions of two adjacent panels.

5. A roofing assembly as claimed in claim 3, wherein the lip portions of each gutter extends inwards and downwards, and the edge portions of the panels correspondingly extend downwards, so that the edge portions are parallel to the lip portions.

6. A roofing assembly as claimed in claim 3, wherein the first clip portions hold the lip portions of the gutters to respective edge portions.

7. A roofing assembly as claimed in claim 6, wherein each clip includes a central portion having a generally inverted L-shaped cross-section and comprising a top limb and a side limb, with the central portion disposed between the first and second clip portions, the top limb being located adjacent a respective edge portion of a panel and the side limb being located adjacent a respective upstanding portion.

8. A roofing assembly as claimed in claim 1, 5 or 7, wherein the panels, gutters and clips are formed from a metal.

9. A roofing assembly as claimed in claim 1, 5 or 7, wherein the panels, gutters and clips are formed from steel.

10. A roofing assembly as claimed in claim 1, 5 or 7, wherein the panels, and gutters are formed from mild steel, and the clips are formed from a spring steel.

11. A roofing assembly as claimed in claim 7, wherein the first clip portion extends from the top limb of the central portion towards the side limb, and includes an outwardly curved lip, to facilitate engagement of the first clip portion with a respective gutter and roof panel.

12. A roofing assembly as claimed in claim 11, wherein the second clip portion comprises a straight section extending at an oblique angle from the side limb.

13. A roofing assembly as claimed in claim 7, wherein the first clip portion extends from the top limb of the central portion towards the side limb and includes an upwardly curved portion, and the top limb includes a corresponding upwardly curved portion.

14. A roofing assembly as claimed in claim 13, wherein the side limb is shorter than the top limb, and the second clip portion comprises a straight section extending at an oblique angle to the side limb and connected to the side limb by a connecting portion which is at a greater angle to the vertical than the straight section.

15. A roofing assembly as claimed in claim 14, wherein the second clip portion includes an edge region which is inclined at a greater angle to the vertical than the straight section.

16. A roofing assembly as claimed in claim 12, 14 or 15, wherein the batten member comprises a top portion, two side members extending at an angle down from the top portion, and two generally coplanar lip portions extending from the side members towards on another, the batten member having a generally trapezoidal cross-section.

17. A roofing assembly as claimed in claim 1, which is located on an underlying support structure, and which includes fastening elements passing through holes in the bottom of the gutters to the support structure.

18. A roofing assembly as claimed in claim 17, wherein the fastening elements comprise screws, with sealing elements located between heads of the screws and the bottoms of the gutters.

* * * * *